US007487836B2

(12) United States Patent
Boyce et al.

(10) Patent No.: US 7,487,836 B2
(45) Date of Patent: Feb. 10, 2009

(54) RISERLESS MODULAR SUBSEA WELL INTERVENTION, METHOD AND APPARATUS

(75) Inventors: Charles B. Boyce, New Ulm, TX (US); William R. Bath, Cypress, TX (US)

(73) Assignee: Saipem America Inc., Houston, TX (US)

( * ) Notice: Subject to any disclaimer, the term of this patent is extended or adjusted under 35 U.S.C. 154(b) by 146 days.

(21) Appl. No.: 11/078,119

(22) Filed: Mar. 11, 2005

(65) Prior Publication Data

US 2006/0231263 A1 Oct. 19, 2006

(51) Int. Cl.
*E21B 29/12* (2006.01)

(52) U.S. Cl. ..... 166/340; 166/338; 166/365; 166/381

(58) Field of Classification Search ..... 166/363, 166/338, 339, 340, 351, 364, 365, 381, 379
See application file for complete search history.

(56) References Cited

U.S. PATENT DOCUMENTS

| | | | | | |
|---|---|---|---|---|---|
| 3,682,243 | A * | 8/1972 | Bauer et al. | ..... | 166/338 |
| 4,306,623 | A * | 12/1981 | Brooks | ..... | 166/322 |
| 4,331,203 | A * | 5/1982 | Kiefer | ..... | 166/339 |
| 4,577,693 | A * | 3/1986 | Graser | ..... | 166/338 |
| 4,673,041 | A | 6/1987 | Turner et al. | ..... | 166/340 |
| 4,730,677 | A * | 3/1988 | Pearce et al. | ..... | 166/345 |
| 4,825,953 | A * | 5/1989 | Wong et al. | ..... | 166/338 |
| 4,867,605 | A * | 9/1989 | Myers et al. | ..... | 405/169 |
| 4,993,492 | A * | 2/1991 | Cressey et al. | ..... | 166/339 |
| 6,102,124 | A * | 8/2000 | Skeels et al. | ..... | 166/347 |
| 6,484,806 | B2 * | 11/2002 | Childers et al. | ..... | 166/351 |
| 6,494,266 | B2 * | 12/2002 | Bartlett et al. | ..... | 166/339 |
| 6,591,913 | B2 * | 7/2003 | Reaux et al. | ..... | 166/352 |
| 6,745,840 | B2 * | 6/2004 | Headworth | ..... | 166/346 |
| 6,763,889 | B2 * | 7/2004 | Rytlewski et al. | ..... | 166/338 |
| 6,817,417 | B2 * | 11/2004 | Blair et al. | ..... | 166/335 |
| 7,063,157 | B2 * | 6/2006 | Bartlett | ..... | 166/339 |
| 7,114,571 | B2 * | 10/2006 | Gatherar et al. | ..... | 166/367 |
| 7,156,169 | B2 * | 1/2007 | Bartlett | ..... | 166/66.7 |
| 7,331,394 | B2 * | 2/2008 | Edwards et al. | ..... | 166/339 |
| 2002/0000320 | A1 * | 1/2002 | Gissler | ..... | 166/340 |
| 2002/0070033 | A1 * | 6/2002 | Headworth | ..... | 166/384 |
| 2003/0145994 | A1 | 8/2003 | Gatherar et al. | ..... | 166/339 |
| 2006/0151175 | A1 * | 7/2006 | Sundararajan et al. | ..... | 166/338 |

OTHER PUBLICATIONS (Form PCT/ISA/220) PCT Notification of Transmittal of the International Search Report & the Written Opinion of the International Searching Authority, or the Declaration Mailed Jun. 14, 2006, for PCT/US2006/008938, Filed Mar. 10, 2006.

* cited by examiner

*Primary Examiner*—Thomas A Beach
(74) *Attorney, Agent, or Firm*—Howrey LLP

(57) ABSTRACT

A subsea well intervention system that permits dynamic disconnection from subsea well intervention equipment without removing any of the equipment during a drive-off condition is provided. The system includes a blowout preventer module operatively connected to a subsea tree, a lubricator assembly attached to the blowout preventer module that provides access to the interior of the blowout preventer and the subsea tree by well intervention equipment, and an umbilical module including a fail-safe disconnect assembly. The fail-safe disconnect assembly is disconnected using hydraulic power provided by the control umbilical or by a remotely operated vehicle.

29 Claims, 5 Drawing Sheets

RISERLESS MODULAR SUBSEA WELL INTERVENTION, METHOD AND APPARATUS

BACKGROUND OF THE INVENTION

The present invention relates generally to a subsea well intervention system, and more specifically to a riserless modular subsea well intervention system.

Oil and gas wells frequently require subsurface maintenance and remediation to maintain adequate flow or production. This activity is commonly referred to as "workover." During the workover specialized tools are lowered into the well by means of a wire line and winch. This wire line winch is typically positioned on the surface and the workover tool is lowered into the well through a lubricator and blowout preventer (BOP). Workover operations on subsea wells require specialized intervention equipment to pass through the water column and to gain access to the well. The system of valves on the wellhead is commonly referred to as the "tree" and the intervention equipment is attached to the tree with a BOP.

The commonly used method for accessing a subsea well first requires installation of a BOP with a pre-attached running tool for guiding the BOP to correctly align and interface with the tree. The BOP/running tool is lowered from a derrick that is mounted on a surface vessel such as a drill ship or semi-submersible platform. The BOP/running tool is lowered on a segmented length of pipe called a "workover string". The BOP/running tool is lowered by adding sections of pipe to the workover string until the BOP/running tool is sufficiently deep to allow landing on the tree. After the BOP is attached to the tree, the workover tool is lowered into the well through a lubricator mounted on the top of the workover string. The lubricator provides a sealing system at the entrance of the wire line that maintains the pressure and fluids inside the well and the workover string. The main disadvantage of this method is the large, specialized vessel that is required to deploy the workover string and the workover string needed to deploy the BOP.

Another common method for well intervention involves the use of a remotely operated vehicle (ROV) and a subsea lubricator to eliminate the need for the workover string and therefore the need for a large, specialized vessel. Current state of the art methods require that the BOP and lubricator are assembled on the surface and then lowered to the seafloor with winches. When the BOP is in the vicinity of the tree, the ROV is used to guide the BOP/lubricator package into position and lock it to the tree. A control umbilical, attached to the BOP/lubricator package is then used to operate the various functions required to access the well. The workover tool can then be lowered on a wire line winch and the ROV is utilized to install the tool in the lubricator so that workover operations can be accomplished. The umbilical provides control functions for the BOP as well as a conduit for fluids circulated in the lubricator.

A common problem with both the workover string method and the BOP/lubricator package method is encountered during a "drive-off" condition. A drive-off condition occurs when by accident or design the surface vessel is forced to move away from its position over the well without first recovering the equipment attached to the tree. Vessels in deep water are commonly held in position over the well by computer controlled, dynamic thrusters. If for any reason, there is a failure in the computer, the thrusters, or any related equipment, the vessel will not be able to hold position or it may be driven off position by incorrect action of the thrusters. In the event of a drive-off condition, the operator must close the valves on the tree and release the BOP so that the intervention equipment can be pulled free of the well. With the drill string method, the BOP is supported by the drill string. With the BOP/Lubricator method, the equipment must be lifted by the surface winches that must be kept continuously attached to the BOP/lubricator equipment. In either case, large pieces of equipment remain hanging below the vessel until they can be recovered.

What is needed is a method and apparatus for the installation of subsea well intervention equipment that eliminates the need to recover the equipment in a drive-off condition.

SUMMARY OF THE INVENTION

A riserless subsea well intervention system that permits dynamic disconnection from subsea well intervention equipment without removing any of the equipment during a drive-off condition is provided. The system includes a blowout preventer module operatively connected to a subsea tree, a lubricator assembly including a disconnect module functionally attached to the blowout preventer module, and an umbilical module including a fail-safe disconnect assembly. A running tool module is utilized to functionally guide the blowout preventer module into alignment with the subsea tree. The lubricator assembly is functionally effective to provide access to the interior of the blowout preventer and the subsea tree by well intervention equipment. The umbilical module is functionally connected to a control mechanism, and includes one or more release systems for disconnecting at least the blowout preventer module from the remaining components of the well intervention system. The fail-safe disconnect assembly is disconnected preferably using hydraulic power provided by the umbilical, or alternatively by a remotely operated vehicle.

Also disclosed is a method for constructing a riserless subsea well intervention system. The method includes connecting a blowout preventer module to a subsea tree, connecting a lubricator module to the blowout preventer module, and connecting an umbilical module to the lubricator module using a fail-safe disconnect. Each of these steps is preferably carried out by a remotely operated vehicle. In this manner, the fail-safe disconnect can be disconnected during a drive-off condition so that the blowout preventer module and the lubricator module, as well as other well intervention equipment, remain connected to the subsea tree.

Also disclosed is a preferred embodiment of the fail-safe disconnect assembly, which includes a male disconnect coupling having a coupling actuator. The male disconnect coupling is connected to the coupling receptacle of a female disconnect coupling. The female disconnect coupling is preferably located on the lubricator module. The fail-safe disconnect assembly is disconnected using hydraulic power provided by the umbilical or by a remotely operated vehicle.

BRIEF DESCRIPTION OF THE DRAWINGS

A more complete understanding of the present invention may be obtained with reference to the accompanying drawings.

DESCRIPTION OF ILLUSTRATIVE EMBODIMENTS

The method and apparatus described herein allows modular installation of a riserless subsea well intervention equipment and eliminates the need to recover the equipment in a drive-off condition. Dynamic disconnection from the tree-mounted equipment is accomplished by a special, fail-safe disconnect assembly, half of which is fitted to the subsea end of the umbilical and the other half being mounted to the lower end of the lubricator assembly. The system described herein has the further advantage of operation with a smaller vessel than prior art systems because of the smaller and less specialized surface handling equipment used by the present invention (hydraulic reservoir skid, hydraulic accumulator, hydraulic power unit, and hydraulic umbilical reel). Furthermore, leaving the subsea equipment secured to the tree during a drive-off condition reduces the disconnect time and provides less risk of damage to the tree or the environment.

Figure 1:
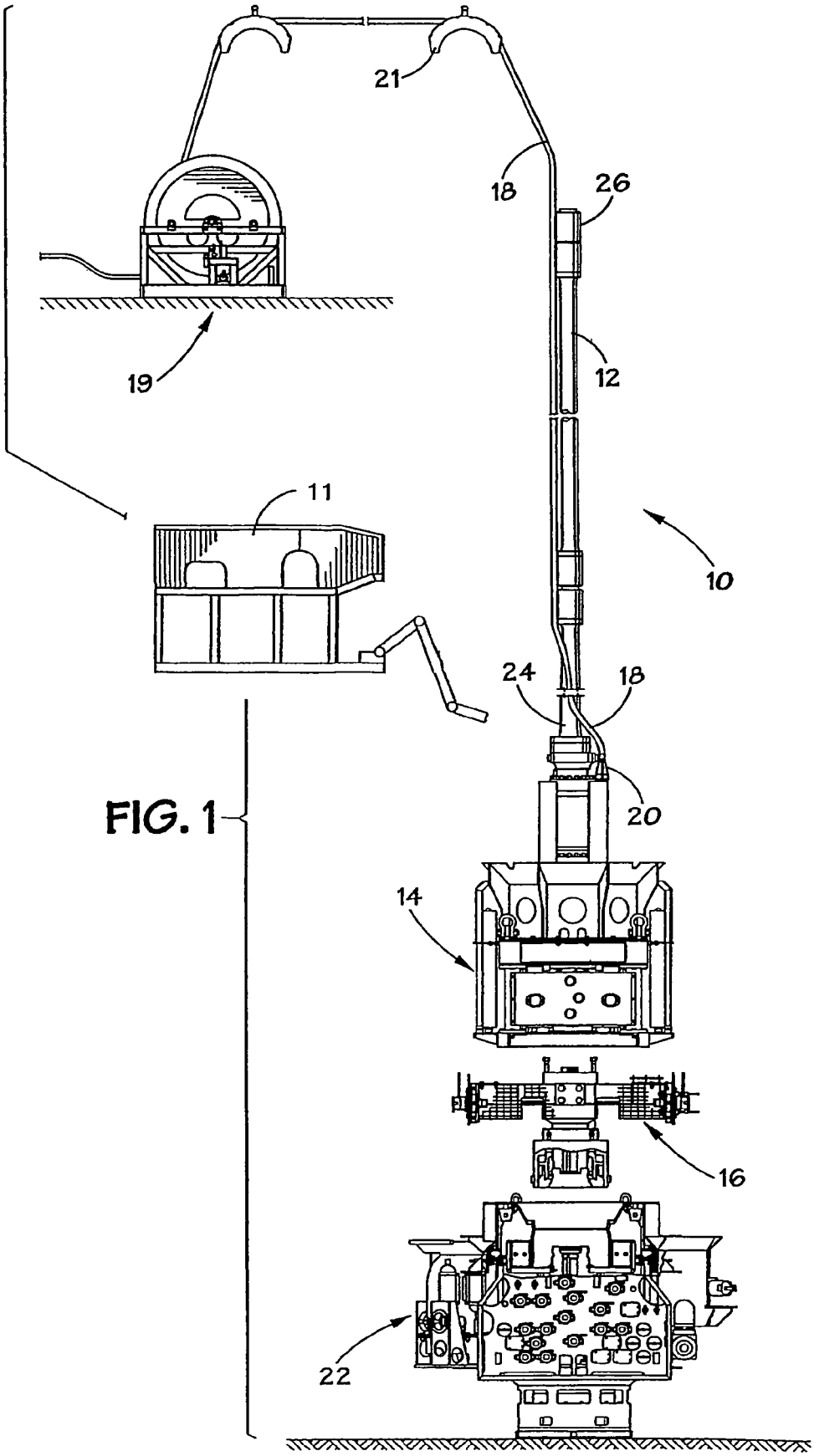
FIG. 1 shows an illustrative embodiment of a riserless modular subsea well intervention system of the present invention.

Referring to FIG. 1, a preferred embodiment of the present invention is illustrated. The subsea well intervention system 10 consists of a lubricator assembly 12, a subsea blowout preventer module 14, a running tool module 16, and an umbilical 18, such as a 7-line umbilical, with fail-safe disconnect assembly 20. One of skill in the art will appreciate that an umbilical control system is required to implement the present invention and includes, without limitation, an umbilical reel assembly 19, umbilical sheaves 21, a hydraulic reservoir skid (not shown), a hydraulic accumulator (not shown), and a hydraulic power unit with an interruptible power supply (not shown). Blowout preventer module (BOP) 14 is operatively connectable to a subsea tree 22 using pre-attached running tool module 16, which is functionally effective to guide BOP 14 into alignment with the subsea tree 22. Running tool module 16 is selected to specifically fit the target subsea tree and is commonly manufactured either by or for the tree's manufacturer for such a purpose.

Lubricator assembly 12 is operatively connectable to BOP 14 and is functionally effective to provide access to the interior of BOP 14 and subsea tree 22 by well intervention equipment (not shown). Lubricator assembly 12 includes a tapered stress joint 24 for control of bending loads applied to BOP 14 and a grease head 26 for insertion of the workover tool (not shown). Lubricator assembly 12 also includes necessary valves and flow passages that all the seals between all components can be tested before the tree valves are opened.

Umbilical 18 is functionally connected to a control mechanism (not shown). Umbilical 18 contains one or more release systems for disconnecting at least BOP 14 from the remaining components of the subsea well intervention system. A preferred embodiment of such a release system is fail-safe disconnect assembly 20. Disconnect assembly 20 is used to connect the umbilical 18 to subsea well intervention equipment, and specifically to lubricator assembly 12. The disconnect assembly 20 is "fail-safe" in that it is hydraulically powered to connect and it remains connected until hydraulically powered to release. Normal operation of disconnect assembly 20 is controlled through the umbilical 18. A secondary release system, operated by an 11 ROV is also provided. The multiple hose passages of the umbilical 18 are sealed by mechanical valves that are opened as the disconnect assembly 20 is powered to the connect condition and automatically closed as the disconnect assembly 20 is powered to release.

Figure 2:
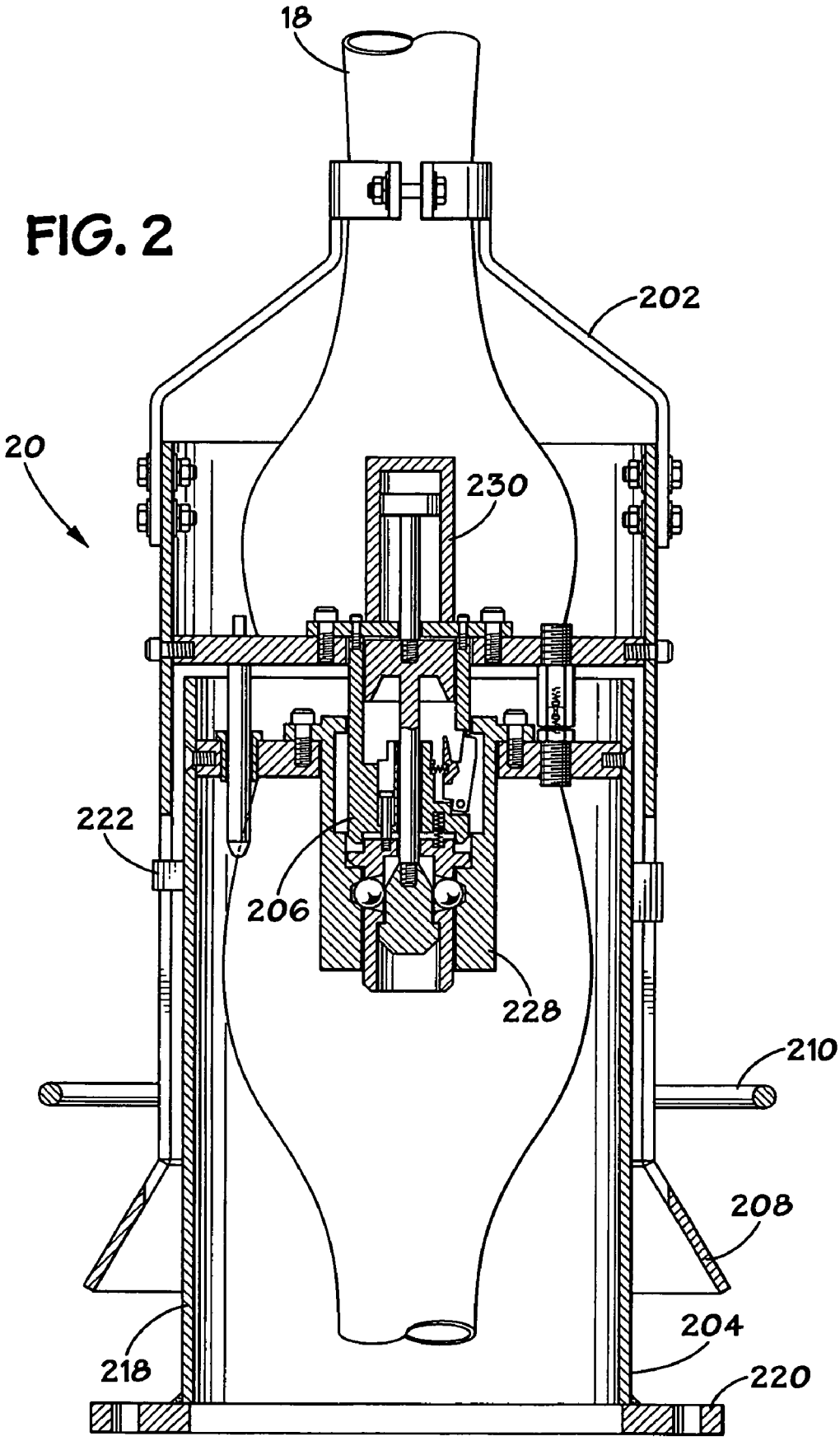
FIG. 2 shows a preferred embodiment of the disconnect assembly of the present invention.

Referring to FIGS. 2-5, a preferred embodiment of the fail-safe disconnect assembly 20 is illustrated. FIG. 2 shows the disconnect assembly 20 with male disconnect coupling 202 and female disconnect coupling 204 connected.

Figure 3A:
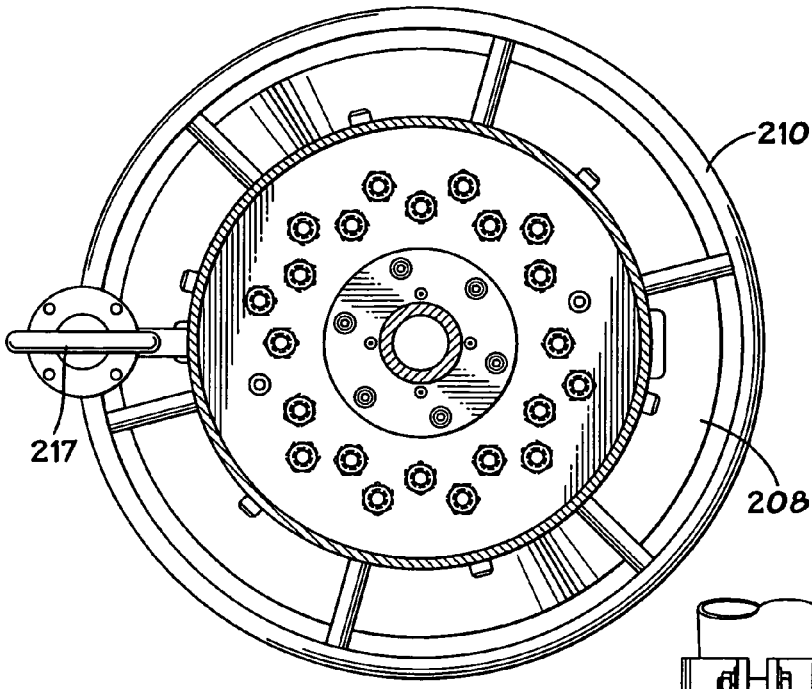
FIGS. 3A and 3B illustrates the male disconnect coupling of the disconnect assembly of FIG. 2.
Figure 3B:
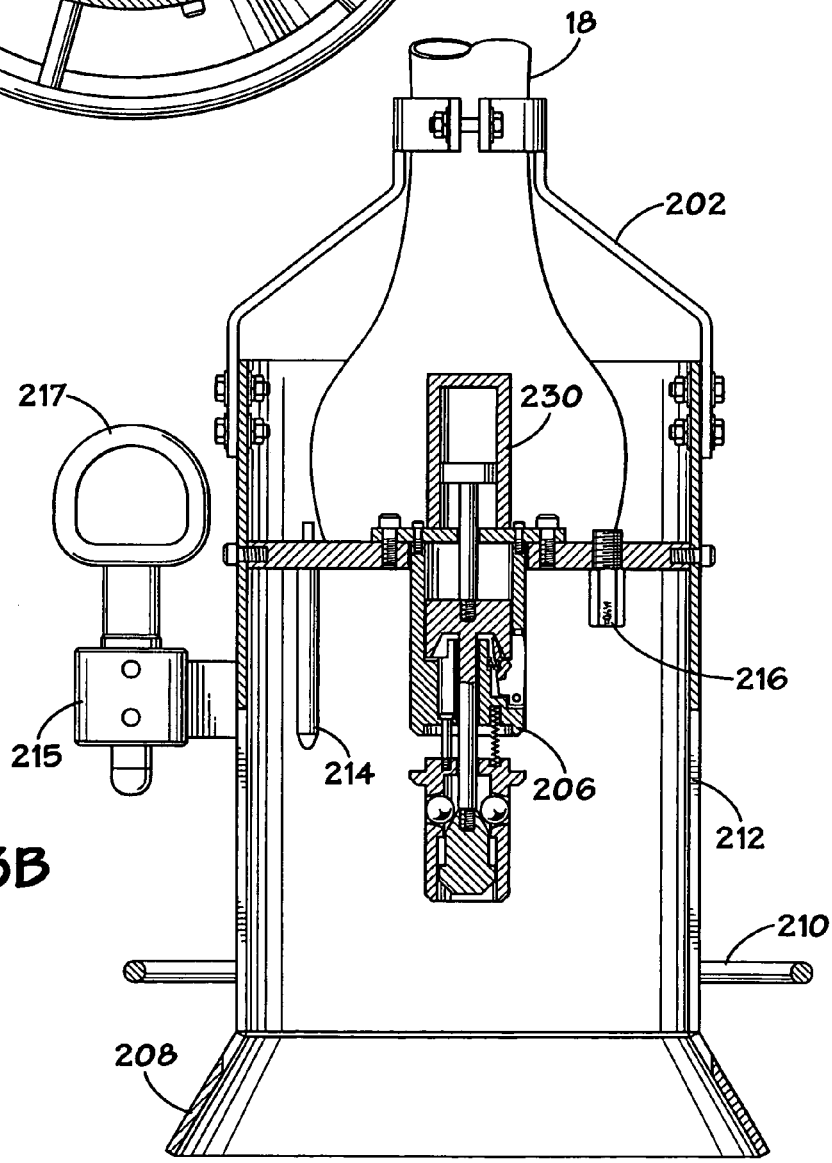
Figure 4B:
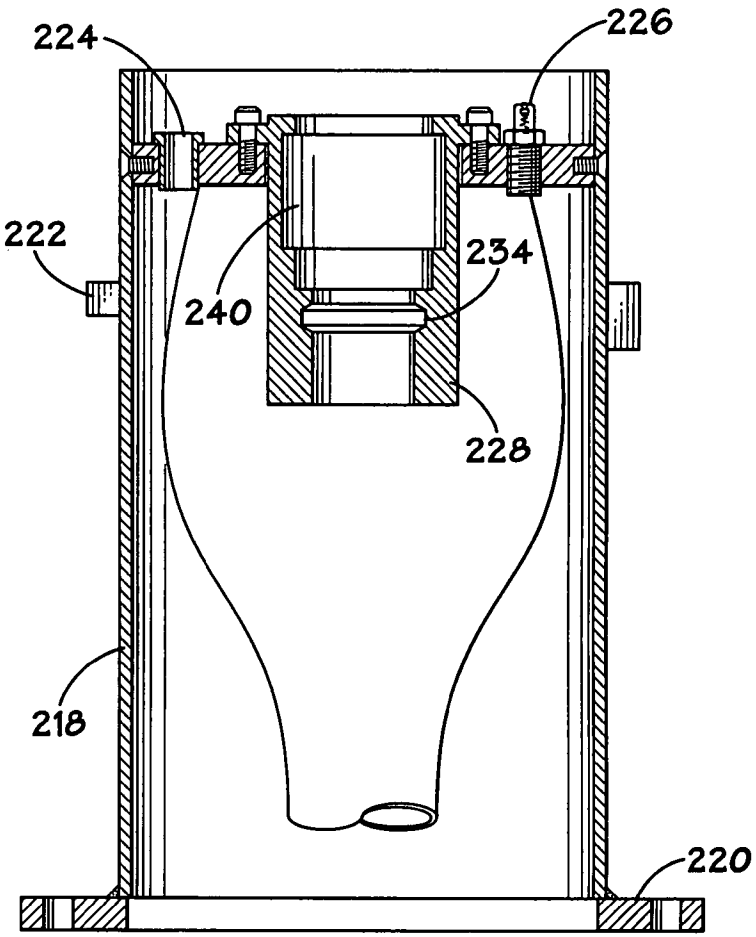
FIGS. 4A and 4B illustrates the female disconnect coupling of the disconnect assembly of FIG. 2.
Figure 4A:
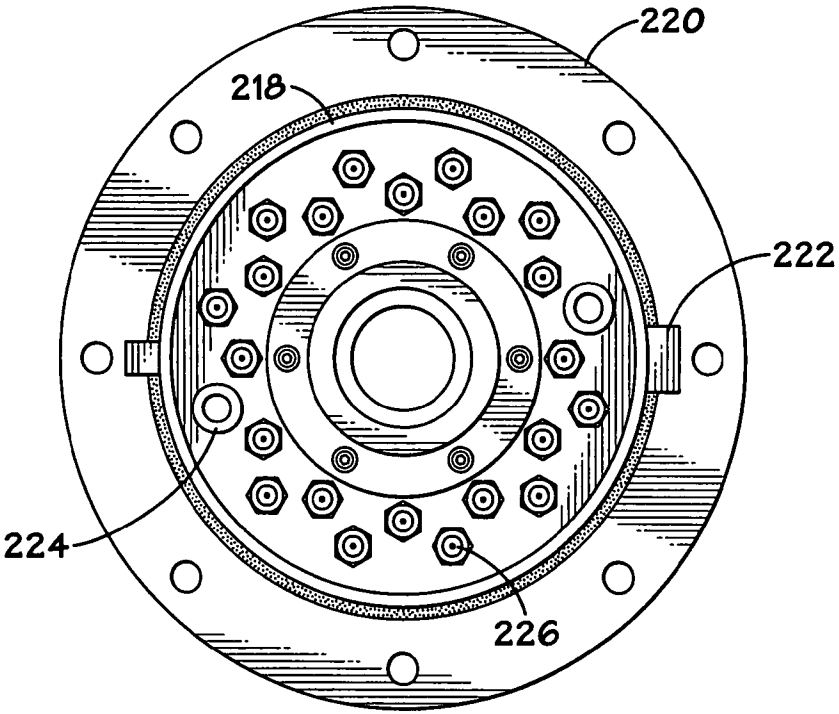

FIGS. 3A and 3B show the male disconnect coupling 202 having a guide cone 208, an ROV handle 210, an alignment guide slot 212, an index pin 214, a female hose connector 216, and a coupling actuator 206. The male disconnect coupling also features a secondary release ROV hot stab 215 with a protective plug 217. FIGS. 4A and 4B show the female disconnect coupling 204 having a support housing 218, a mounting flange 220, an alignment guide 222, an index pin receptacle 224, a male hose connector 226, and a coupling receptacle 228.

In a preferred aspect of the present invention, female disconnect coupling 204 is mounted prior to subsea installation on lubricator assembly 12 using mounting flange 220. An 11 ROV is then used to connect the male disconnect coupling 202 (attached to the umbilical 18) to the female disconnect coupling 204. The ROV's manipulator is used to"grab" the ROV handle 210 and guide the two coupling halves together using guide cone 210. Alignment guide 222 and alignment guide slot 212, as well as index pin 214 and index pin receptacle 224, are then utilized to properly position male coupling actuator 206 with female couple receptacle 228.

Figure 5B:
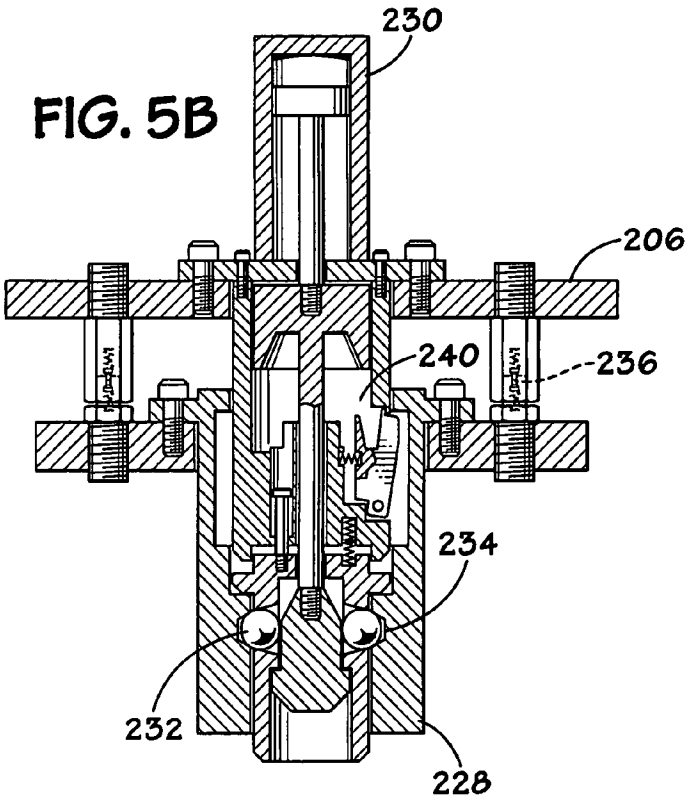
FIGS. 5A and 5B illustrates the hydraulically powered connection made by the disconnect assembly of FIG. 2.
Figure 5A:
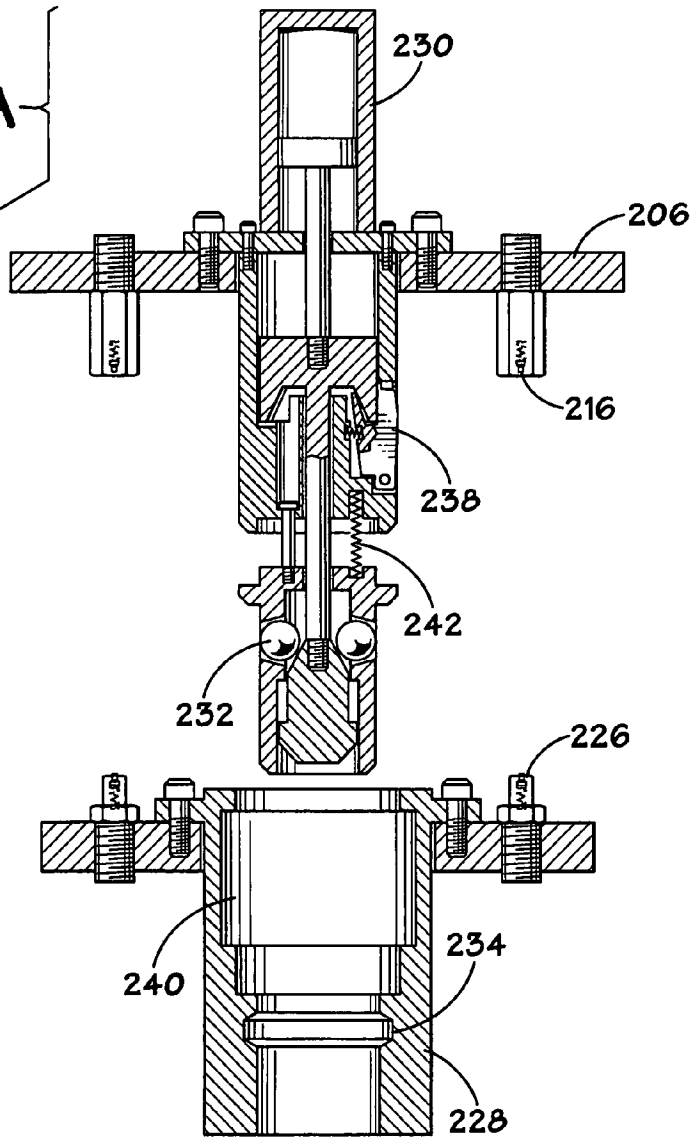

As shown in FIGS. 5A and 5B, the hydraulically powered connection and disconnection of the fail-safe disconnect assembly 20 is accomplished with a single hydraulic cylinder 230. The force required to engage the umbilical hose connectors 216, 226 is provided by the hydraulic cylinder 230 pulling the coupling actuator 206 into the coupling receptacle 228. Once the male coupling actuator 206 is landed on the female coupling receptacle 228, initial retraction of the hydraulic cylinder 230 in the actuator 206 operates a ball grab 232 that locks into a recess 234 in the female receptacle 228. As the hydraulic cylinder 230 continues to retract, the hose connectors 216, 226 are pulled together and forced to engage. Engagement of the hose connectors 216, 226 causes the check valves 236 in both the male and female hose connectors 216, 226 to open. Continued retraction of the hydraulic cylinder 230 allows mechanical latches 238 in the actuator 206 to engage a recess 240 in the receptacle 228. After the latches 238 are engaged, the coupling halves are locked together and no further action of the hydraulic cylinder 230 is required.

Disconnection is achieved by extending the hydraulic cylinder 230. Cylinder extension may be powered through the umbilical 18 or by an 11 ROV using the secondary release hot stab 215 as shown in FIG. 3A. As the cylinder 230 extends, a cam on the cylinder rod retracts the mechanical latches 238 in the actuator 206 and the coupling halves are biased apart due to the force of grab spring 242. Continued extension of the hydraulic cylinder 230 allows the ball grab 232 to retract and the male coupling half is thereby disconnected.

Another embodiment of the present invention is a method for constructing a riserless subsea well intervention system including the steps of first connecting a blowout preventer module having a pre-attached running tool to a subsea tree, then connecting a lubricator assembly to the blowout preventer module, and finally connecting an umbilical to the disconnect module using a fail-safe disconnect. Each of these connections is preferably carried out by an ROV. In this manner the fail-safe disconnect can be disconnected during a drive-off condition, thereby the blowout preventer module including the running tool and the lubricator assembly remain connected to the subsea tree during the drive-off condition. The fail-safe disconnect preferably contains a male coupling half located on the umbilical and a female coupling half located on the lubricator assembly. The fail-safe disconnect is preferably disconnected using hydraulic power provided by the umbilical, or alternatively using hydraulic power provided by an ROV.

It will be apparent to one of skill in the art that described herein is a novel method and apparatus for installing and disconnecting a riserless modular subsea well intervention system. While the invention has been described with references to specific preferred and exemplary embodiments, it is not limited to these embodiments. For example, although the invention herein is described in reference to a specific preferred fail-safe disconnect assembly, it should be understood that the teaching of the present invention are equally applicable to other alternative disconnect assemblies. The invention may be modified or varied in many ways and such modifications and variations as would be obvious to one of skill in the art are within the scope and spirit of the invention and are included within the scope of the following claims.

What is claimed is:

1. A subsea well intervention system, said system permitting dynamic disconnection from subsea well intervention equipment without removing any of said subsea well intervention equipment, said system comprising:

(a) a blowout preventer module operatively connected to a subsea tree;

(b) a lubricator assembly including a first portion of a disconnect assembly, said lubricator assembly functionally attached to said blowout preventer module, said lubricator assembly being functionally effective to provide access to the interior of said blowout preventer and said subsea tree by well intervention equipment;

(c) an umbilical module including a second portion of a disconnect assembly that is positioned for subsea connection by a remotely operated vehicle, said umbilical module being functionally connected to a control mechanism, and said umbilical module including one or more release systems for disconnecting at least said blowout preventer module from the remaining components of said well intervention system; and (d) a hydraulic coupling actuator that operatively connects the first portion of a disconnect assembly with the second portion of the disconnect assembly.

2. The system of claim 1, wherein the blowout preventer module is connected to a running tool module, said running tool module being functionally effective to guide said blowout preventer module into alignment with the subsea tree.

3. The system of claim 2, wherein the blowout preventer module and the running tool module are connected together before deployment.

4. The system of claim 1, wherein the system is riserless.

5. The system of claim 1, wherein the lubricator module comprises a grease head for insertion of a workover tool.

6. The system of claim 1, wherein the second portion of a disconnect assembly comprises a male disconnect coupling.

7. The system of claim 6, wherein the male disconnect coupling comprises a coupling actuator.

8. The system of claim 6, wherein the male disconnect coupling is connected to a female disconnect coupling using hydraulic power.

9. The system of claim 6, wherein the male disconnect coupling is disconnected from a female disconnect coupling using hydraulic power.

10. The system of claims 8 or 9, wherein the female disconnect coupling comprises a coupling receptacle.

11. The system of claims 8 or 9, wherein the first portion of a disconnect assembly comprises the female disconnect coupling.

12. The system of claims 8 or 9, wherein the hydraulic power is provided by the umbilical.

13. The system of claims 8 or 9, wherein the hydraulic power is provided by a remotely operated vehicle.

14. A riserless subsea well intervention system, said system permitting dynamic disconnection from subsea well intervention equipment without removing any of said subsea well intervention equipment, said system comprising:

(a) a blowout preventer module operatively connected to a subsea tree;

(b) a lubricator assembly including a first portion of a disconnect assembly, said lubricator assembly functionally attached to said blowout preventer module, said lubricator assembly being functionally effective to provide access to the interior of said blowout preventer and said subsea tree by well intervention equipment;

(c) an umbilical module including a second portion of a disconnect assembly that is positioned for subsea connection by a remotely operated vehicle, said umbilical module being functionally connected to a control mechanism, and said umbilical module including one or more release systems for disconnecting at least said blowout preventer module from the remaining components of said well intervention system; and (d) a coupling actuator that operatively connects the first portion of a disconnect assembly with the second portion of the disconnect assembly.

15. A riserless subsea well intervention system, said system permitting dynamic disconnection from subsea well intervention equipment without removing any of said subsea well intervention equipment, said system comprising:

(a) a blowout preventer module operatively connected to a running tool module, said running tool module being functionally effective to guide said blowout preventer module into alignment with a subsea tree;

(b) a lubricator assembly functionally attached to said blowout preventer module, said lubricator assembly being functionally effective to provide access to the interior of said blowout preventer and said subsea tree by well intervention equipment;

(c) an umbilical module including a disconnect assembly that is positioned for subsea connection by a remotely operated vehicle, said umbilical module being functionally connected to a control mechanism, and said umbilical module including one or more release systems for disconnecting at least said blowout preventer module from the remaining components of said well intervention system during a drive-off condition;

(d) wherein said one or more release systems includes hydraulically operated failsafe disconnect components; and (e) a hydraulic coupling actuator that operatively connects the umbilical module to another component of the subsea well intervention system.

16. The system of claim 15, wherein the blowout preventer module and the running tool module are connected together before deployment.

17. The system of claim 15, wherein the lubricator module comprises a grease head for insertion of a workover tool.

18. A method for constructing a riserless subsea well intervention system, comprising: connecting a blowout preventer module to a subsea tree; connecting a lubricator module to the blowout preventer module; and the subsea positioning of an umbilical module by a remotely operated vehicle for the connection to the lubricator module using a fail-safe disconnect, wherein a hydraulic coupling actuator operatively connects the umbilical module to the lubricator module.

19. The method of claim 18, wherein the connecting steps are carried out by a remotely operated vehicle.

20. The method of claim 18, wherein the blowout preventer module is connected to a running tool module, said running tool module being functionally effective to guide said blowout preventer module into alignment with the subsea tree.

21. The method of claim 18, wherein the fail-safe disconnect can be disconnected from the remaining components of said well intervention system during a drive-off condition.

22. The method of claim 21, wherein blowout preventer module and the lubricator module remain connected to the subsea tree during the drive-off condition.

23. The method of claim 18, wherein the fail-safe disconnect comprises a male disconnect coupling located on the umbilical.

24. The method of claim 18, wherein the fail-safe disconnect comprises a female disconnect coupling located on the lubricator module.

25. The method of claim 18, wherein the fail-safe disconnect is disconnected using hydraulic power.

26. The method of claim 25, wherein the hydraulic power is provided by the umbilical module.

27. The method of claim 25, wherein the hydraulic power is provided by a remotely operated vehicle.

28. The system of claim 1, wherein the first portion of a disconnect assembly contains a first plurality of conduits and the second portion of a disconnect assembly contains a second plurality of conduits, wherein the hydraulic coupling actuator operatively connects the first plurality of conduits with the second plurality of conduits.

29. The method of claim 18, wherein the umbilical module contains a plurality of conduits that are operatively connected by the hydraulic coupling actuator to the remaining components of said well intervention system.

* * * * *